US007343970B2

(12) United States Patent
Lopez de Cardenas et al.

(10) Patent No.: US 7,343,970 B2
(45) Date of Patent: Mar. 18, 2008

(54) REAL TIME OPTIMIZATION OF WELL PRODUCTION WITHOUT CREATING UNDUE RISK OF FORMATION INSTABILITY

(75) Inventors: Jorge E. Lopez de Cardenas, Sugar Land, TX (US); Adinathan Venkitaraman, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 466 days.

(21) Appl. No.: 10/727,870

(22) Filed: Dec. 4, 2003

(65) Prior Publication Data

US 2005/0121197 A1 Jun. 9, 2005

(51) Int. Cl.
*E21B 47/06* (2006.01)

(52) U.S. Cl. ..... 166/250.07; 166/53; 166/250.15

(58) Field of Classification Search ..... 166/53, 166/250.07, 250.17, 250.15
See application file for complete search history.

(56) References Cited

U.S. PATENT DOCUMENTS

| | | | | |
|---|---|---|---|---|
| 4,926,942 | A | 5/1990 | Profrock, Jr. | |
| 5,117,399 | A * | 5/1992 | McCoy et al. | 367/99 |
| 5,273,112 | A * | 12/1993 | Schultz | 166/374 |
| 6,281,489 | B1 * | 8/2001 | Tubel et al. | 250/227.14 |
| 6,536,522 | B2 * | 3/2003 | Birckhead et al. | 166/250.15 |
| 6,554,064 | B1 | 4/2003 | Restarick | |
| 2002/0147574 | A1 | 10/2002 | Ong | |
| 2003/0164037 | A1 * | 9/2003 | Moffatt et al. | 73/152.46 |
| 2004/0045707 | A1 | 3/2004 | Nguyen et al. | |

FOREIGN PATENT DOCUMENTS

GB 2342107 A 4/2000

OTHER PUBLICATIONS

SPE Paper # 2009: Henderson, Dempsey & Tyler; Use of Numerical Models to Develop and Operate Gas Storage Reservoirs; Apr. 1968.
SPE Paper # 3499: Stein, Hilchie; Estimating the Maximum Production Rate Possible from Friable Sandstones Without Using Sand Control; Sep. 1972; pp. 1157-1160.
SPE Paper # 7004: Sinclair, Graham; An Effective Method of Sand Control; Feb. 1978.
SPE Paper # 16767: Chen; Pressure Drawdown in a Layered Reservoir With Linear Boundaries; Sep. 1987; pp. 261-266.
SPE Paper # 29331: Moore; Sand Production Prediction; Nov. 1994; p. 955.
SPE Paper # 53140: Awal, Osman; SandPro—A New Application Program for Predicting Onset of Sand Production; Feb. 1999; pp. 1-14.
SPE Paper # 54007: Papamichos, Malmanger; A Sand Erosion Model for Volumetric Sand Predictions in a North Sea Reservoir; Apr. 2000; pp. 1-9.

(Continued)

*Primary Examiner*—David Bagnell
*Assistant Examiner*—Giovanna M Collins
(74) *Attorney, Agent, or Firm*—Van Someren, P.C.; Bryan P. Galloway

(57) ABSTRACT

A system and method is provided for producing fluid from a subterranean formation. A sensor system is used to monitor bottom hole flowing pressure and formation pressure. The relationship of these pressures is utilized in conjunction with a stability envelope of the formation in optimizing fluid production.

12 Claims, 4 Drawing Sheets

OTHER PUBLICATIONS

SPE Paper # 58721: Ong, Ramos, Zheng; Sand Production Prediction in High Rate, Perforated and Open-hole Gas Wells; Feb. 2000; pp. 1-9.

SPE Paper # 58789: Morales, Webb, Hollier; Borehole Failure: Safe Drawdown Pressures and Wellbore Damage Radius; Feb. 2000; pp. 1-6.

SPE Paper # 65510: McLellan, Hawkes, Read; Sand Production Prediction for Horizontal Wells in Gas Storage Reservoirs, Nov. 2000; pp. 14.

SPE Paper # 69841: Papamichos, Malmanger; A Sand-Erosion Model for Volumetric Sand Predictions in a North Sea Reservoir, Feb. 2001; pp. 44-50.

SPE Paper # 75328: Ewy, Ray, Bovberg, Norman, Goodman; Openhole Stability and Sanding Predictions by 3D Extrapolation from Hole-Collapse Tests; Dec. 2001; pp. 243-251.

SPE Paper # 77686: Abass, Nasr-El-Din, Ba Taweel; Sand Control: Sand Characterization, Failure Mechanisms, and Completion Methods; Sep. 2002; pp. 1-8.

SPE Paper # 77979: Ghalambor, Asadi; A Study of Relevant Parameters to Predict Sand Production in Gas Wells; Jun. 2002; pp. 87-98.

SPE Paper # 78169: Chin, Ramos; Predicting Volumetric Sand Production in Weak Reservoirs; Oct. 2002; 1-10.

SPE Paper # 78234: Wu, Tan; Sand Production Prediction of Gas Field—Methodology and Field Application: Oct. 2002; pp. 10.

SPE Paper # 80448: Nouri, Vaziri, Belhaj, Islam; Effect of Volumetric Failure on Sand Production in Oil-Wellbores; Apr. 2003; pp. 1-8.

SPE Paper # 82240: Mathis; Sand Management: A Review of Approaches and Concerns; May 2003; pp. 1-7.

SPE Paper # 84262: King, Wildt, O'Connell; Sand Control Completion Reliability and Failure Rate Comparison with a Multi-Thousand Well Database; Oct. 2003; pp. 1-5.

SPE Paper # 84494: Nisbit, Dria; Implementation of a Robust Deepwater Sand Monitoring Strategy; Oct. 2003; pp. 1-7.

SPE Paper # 84495: Tiffin, Stein, Wang; Drawdown Guidelines for Sand Control Completions; Oct. 2003; pp. 1-10.

SPE Paper # 84496: Van Den Hoek, Geilikman; Prediction of Sand Production Rate in Oil and Gas Reservoirs; Oct. 2003; pp. 1-9.

SPE Paper # 84497: Wong, Fair, Bland, Sherwood; Balancing Act: Gulf of Mexico Sand Control Completions, Peak Rate Versus Risk of Sand Control Failure; Oct. 2003; pp. 1-11.

SPE Paper # 84499: Palmer, Vaziri, Wilson, Moschovidis, Cameron, Ispas; Predicting and Managing Sand Production: A New Strategy; Oct. 2003; pp. 1-13.

SPE Paper # 86536: Brito-Rhor, Kuyucu, Flores; Efficient Alternative to Control Sand Production in Wells with Oil/Water Contact at the Wellbore; Feb. 2004; pp. 1-5.

SPE Paper # 86555: Yi, Valko, Russell; Predicting Critical Drawdown for the Onset of Sand Production; Feb. 2004; pp. 1-12.

SPE Paper # 87004: Yeow, Johar, Wu, Tan, Yaakub; Sand Production Prediction Study Using Empirical and Laboratory Approach for a Multi-Field Gas Development; Mar. 2004; pp. 1-14.

* cited by examiner

REAL TIME OPTIMIZATION OF WELL PRODUCTION WITHOUT CREATING UNDUE RISK OF FORMATION INSTABILITY

BACKGROUND

A variety of fluids are contained in formations found within the Earth. Some of these fluids, such as water and oil, are desirable and may be produced to the Earth's surface for numerous uses. Many types of mechanisms are employed to produce the fluids from subterranean formations. For example, wellbores may be drilled into a formation to accommodate the deployment of a downhole completion used to control the upward production of fluid.

When fluid is removed from a formation, an underbalance of pressure, i.e. drawdown, occurs between the region of fluid intake at the completion and the surrounding reservoir or formation. If the pressure underbalance is too great, however, the formation may become mechanically unstable, resulting in sanding, further formation breakdown or formation compaction or subsidence. If, on the other hand, the pressure underbalance is substantially reduced, the production of fluid can be inefficient. Furthermore, the pressure underbalance (drawdown) that is allowed without incurring information failure may change with time as the producing formation is depleted and the in situ effective stresses increase.

SUMMARY

In general, the present invention provides a method and system for producing a fluid from a subterranean formation. The method and system enable the production of fluid from the formation while controlling the potential for sanding or other mechanical instability of the formation. Additionally, the fluid production may be optimized for a given formation without exceeding a predetermined envelope that defines the stability of the formation during production relative to the pressure underbalance.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a method and system for controlling the production of fluid from a subterranean formation. The method and system are utilized in optimizing fluid production without creating undue risk of formation mechanical instability that can result in sanding. The devices and methodology of the present invention, however, are not limited to the specific applications that are described herein.

Figure 1:
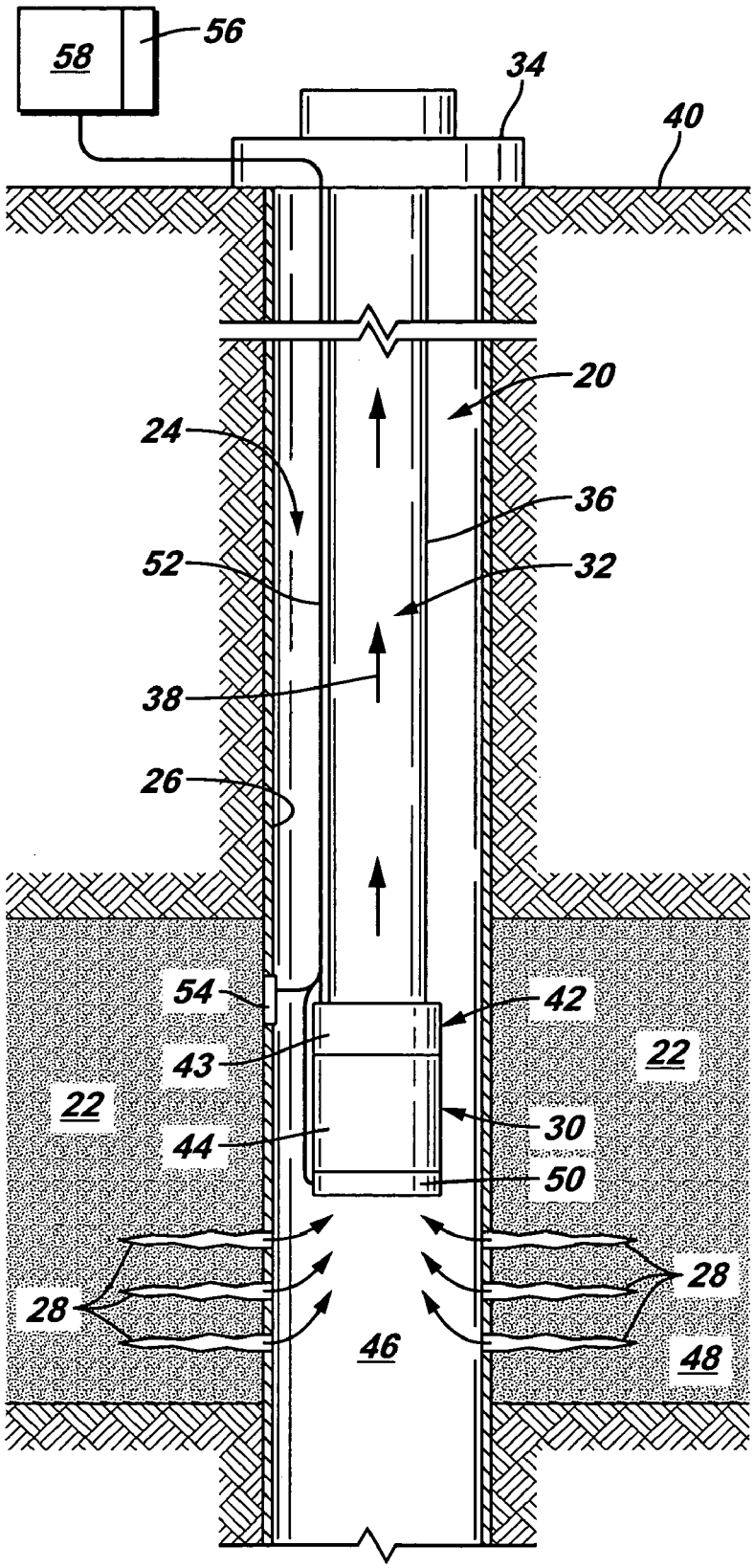
FIG. 1 is a front elevational view of a system for producing a fluid, according to an embodiment of the present invention.

Referring generally to FIG. 1, a system 20 is illustrated according to an embodiment of the present invention. System 20 is disposed in a subterranean environment, such as a subsurface formation 22 holding fluids, e.g. petroleum or water. As illustrated, a wellbore 24 is formed, typically by drilling, in formation 22. The wellbore 24 may be lined with a casing 26 having perforations 28. Perforations 28 provide a passageway for fluid flowing from formation 22 into wellbore 24. However, system 20 also may be utilized with an open hole or sand control completion.

System 20 comprises a completion 30 deployed at a desired location in wellbore 24 by a deployment system 32. Deployment system 32 extends downwardly in wellbore 24 from a well head 34. Deployment system 32 may comprise a tubing 36, such as production tubing or coil tubing. Tubing 36 defines an internal flow path 38 along which fluids are produced to a desired collection point, e.g. a point at a surface 40 of the Earth. It should also be noted that system 20 can be designed such that flow path 38 is located along the annulus between deployment system 32 and casing 26.

Completion 30 may have a variety of configurations. In one example, completion 30 comprises a flow control mechanism 42 controllable to reduce or increase the flow of fluid along flow path 38. Flow control mechanism 42 may comprise a valve or a choke 43. Flow control mechanism 42 also may comprise an artificial lift mechanism 44 able to pump fluid along flow path 38. Artificial lift mechanism 44 may be used as an alternative or in addition to the choke or valve 43, depending on the specific formation. One example of artificial lift mechanism 44 is an electric submersible pumping system.

Regardless of the specific type of completion 30 used in system 20, fluid moves into completion 30 and is produced along flow path 38. It also should be noted that system 20 may have a variety of configurations that can comprise, for example, a completion within a cased wellbore, an open hole completion in a wellbore without a casing and a variety of other sand control devices. In any of these embodiments, fluid entering completion 30 creates a region of lower pressure 46 relative to the reservoir or formation pressure 48. This region of lower pressure 46 is sometimes referred to as the bottom hole flowing pressure, and the difference between bottom hole flowing pressure 46 and the reservoir pressure 48 can be referred to as a pressure underbalance or drawdown. Increasing the rate of fluid production increases the pressure underbalance, but the creation of an underbalance too great for a given formation 22 can lead to mechanical instability of the formation. Mechanical instability can lead to sanding, compaction and other detrimental results.

Referring again to FIG. 1, system 20 further comprises a sensing system 50 able to determine the bottom hole flowing pressure 46. Sensing system 50 may comprise a variety of pressure sensors or other sensors utilized to determine the bottom hole flowing pressure. For example, system 50 may incorporate real-time monitoring and control techniques, intelligent completions, and other techniques for determining bottom hole flowing pressure 46. The data from sensor system 50 may be sent via signals communicated wirelessly or by a control line 52, such as a wire conductor or optical fiber.

System 20 further comprises a reservoir pressure sensing system 54 position to sense reservoir pressure 48. Pressure sensing system 54 also may comprise a variety of sensing techniques, such as the use of real-time pressure sensors or other sensors able to determine reservoir pressure 48. Reservoir pressure sensing system 54 also may transmit data wirelessly or through a control line, such as control line 52. The data from sensing systems 50 and 54 may be transmitted to an interface 56 for comparison. Interface 56 may be positioned locally at the well or at a distant location. System 20 also may comprise an automated control 58 designed to receive the data from sensor systems 50 and 54, compare the data, determine any needed changes in bottom hole flowing pressure, and provide an appropriate control signal to flow control mechanism 42. One example of an automated control 58 is a computerized control utilizing one or more processors that receives the signals from downhole, determines the pressure underbalance, compares the underbalance to a specific stability envelope for the formation 22, and provides appropriate control signals to change the rate of fluid production and thus the bottom hole flowing pressure.

Sensor system 50 and reservoir pressure sensor system 54 both continually monitor bottom hole flowing pressure and reservoir pressure, respectively. The continual monitoring utilizes constant or periodic detection of both bottom hole flowing pressure 46 and reservoir pressure 48 to continually track the pressures and changes in pressures during production of fluid from formation 22. For example, sensor system 50 and reservoir pressure sensor system 54 may operate at a given sampling rate controlled by automated control 58. If the underbalance of pressure 46 relative to pressure 48 becomes too great, valve or choke 43 (or artificial lift mechanism 44) is adjusted to reduce the flow of fluid along flow path 38. The reduction in flow rate effectively increases the bottom hole flowing pressure 46 such that the difference between pressure 46 and reservoir pressure 48 is reduced.

Figure 2:
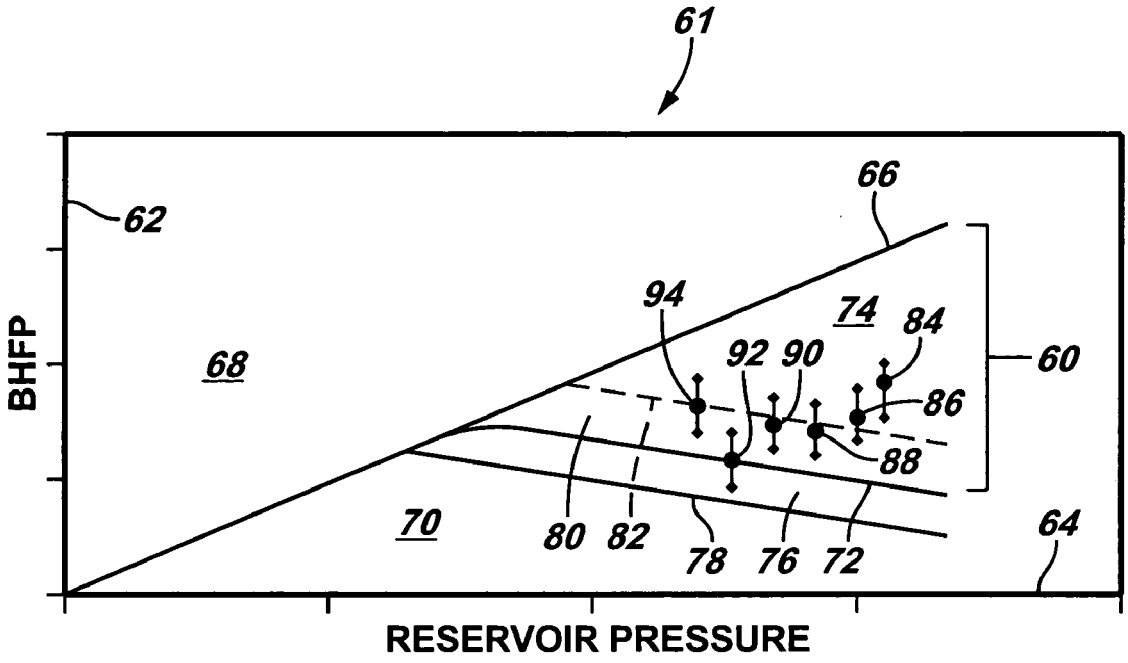
FIG. 2 is a graphical illustration of a stability envelope for a specific formation that may be used with the system illustrated in FIG. 1.

Referring generally to FIG. 2, a graphical representation is provided of a stability envelope 60 for a given formation, such as formation 22. Stability envelopes for specific formations can be developed by available techniques and provide guidance as to the pressure underbalance that will result in flow of wellbore fluid without rendering the formation mechanically unstable.

Stability envelope 60 is illustrated on a graph 61 having a vertical axis 62, representing bottom hole flowing pressure, and a horizontal axis 64, representing reservoir pressure. A line 66 divides the graph into regions of "no flow" 68 and "flow" 70. In other words, line 66 represents an equilibrium of pressure between the bottom hole flowing pressure and the reservoir pressure. When the ratio of bottom hole flowing pressure 46 to reservoir pressure 48 falls below line 66, flow of fluid along flow path 38 can be achieved. However, a formation stability line 72 represents the ratio of bottom hole flowing pressure to reservoir pressure at which the pressure underbalance can lead to mechanical instability of the formation. A safe drawdown region 74 is created between line 66 and stability line 72. If the pressure underbalance remains within safe drawdown region 74, production of wellbore fluid can occur without risking sanding or other detrimental results of mechanical instability of formation 22.

Graph 61 also illustrates a danger zone 76 disposed between stability line 72 and a formation failure line 78. In some formations, there may be a zone of unpredictability, such as danger zone 76, in which the risk of formation failure is increased. Although control schemes or algorithms can be designed that allow the pressure underbalance to enter zone 76, it is often desirable to ensure the pressure underbalance remains within safe drawdown region 74. Also, if the ratio of bottom hole flowing pressure to reservoir pressure falls within zone 76, additional or other preventative and corrective actions can be taken. For example, the controller may be adjusted to increase the sampling rate of the data to improve control over the system 20.

The real-time monitoring of bottom hole flowing pressure 46 and reservoir pressure 48 enables the optimization of fluid production. The pressure underbalance may be continuously controlled to maintain the ratio of bottom hole flowing pressure to reservoir pressure within a specific optimization region 80 of safe drawdown region 74. For example, in FIG. 2, the optimization region 80 (illustrated between stability line 72 and dashed line 82) is located to maximize fluid production without incurring undue sanding. As the reservoir pressure 48 changes during production, the bottom hole flowing pressure may be adjusted to maintain the pressure relationship within optimization region 80. Effectively, the bottom hole flowing pressure 46 is sensed relative to the reservoir pressure 48. The sensed results are compared to a specific stability envelope 60 for the formation 22. If the sensed results do not fall within a desired optimization region, e.g. region 80, fluid production is adjusted to alter the bottom hole flowing pressure such that production remains within the optimization region of the stability envelope 60.

A series of graph points 84, 86, 88, 90, 92 and 94 are illustrated on graph 61 at sequential periods during the production of fluid from reservoir 22. The graph points are illustrative of the comparison of data received from pressure sensing system 50 and reservoir pressure sensing system 54. Based on the sensor data related to graph points 84 and 86, for example, the rate of production is increased via flow control mechanism 42. The increased rate of production will create a lower bottom hole flowing pressure 46, effectively moving graph points 84 and 86 downwardly to optimization region 80. In this example, the continuous monitoring of downhole pressures and the comparison of those pressures with stability envelope 60, enables an increase in production without undue risk of sanding. Graph points 88, 90 and 94 provide an example of when the relative bottom hole flowing pressures and reservoir pressures are at a desired level. However, graph point 92 illustrates the production rate is moving too close to creating mechanical instability within formation 22. Accordingly, flow control mechanism 42 can be adjusted to reduce flow of fluid along flow path 38. The reduction in flow effectively decreases the pressure underbalance and restores operation of system 20 to optimization region 80.

Figure 3:
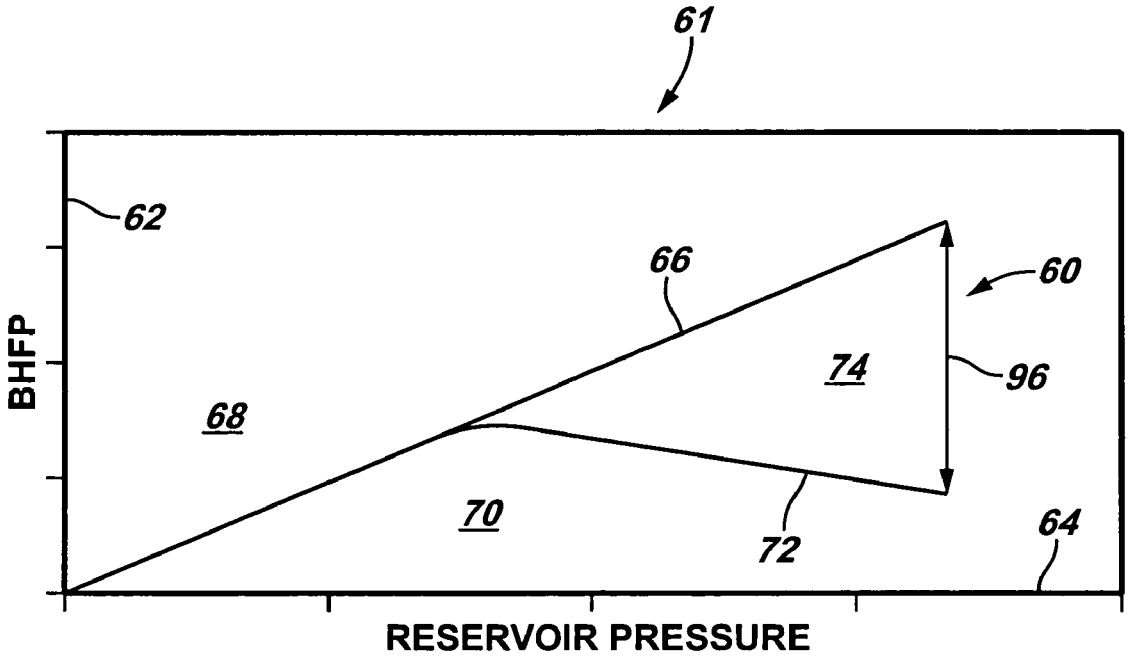
FIG. 3 is another graphical illustration of a specific stability envelope that may be used with the system illustrated in FIG. 1.
Figure 4:
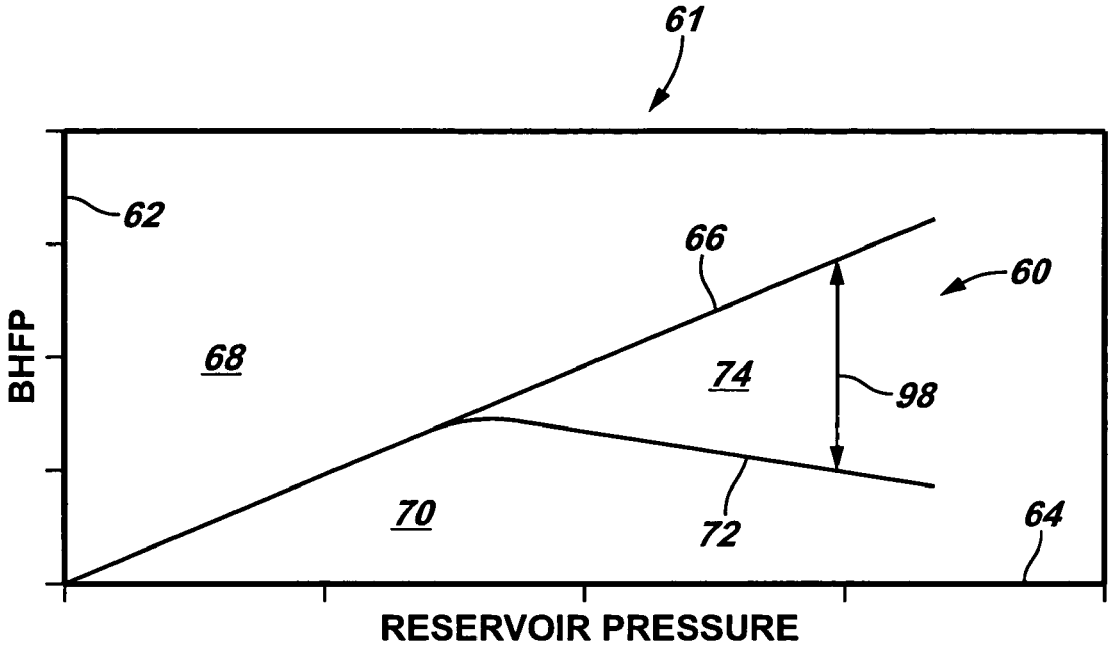
FIG. 4 is another graphical illustration of a specific stability envelope that may be used with the system illustrated in FIG. 1.
Figure 5:
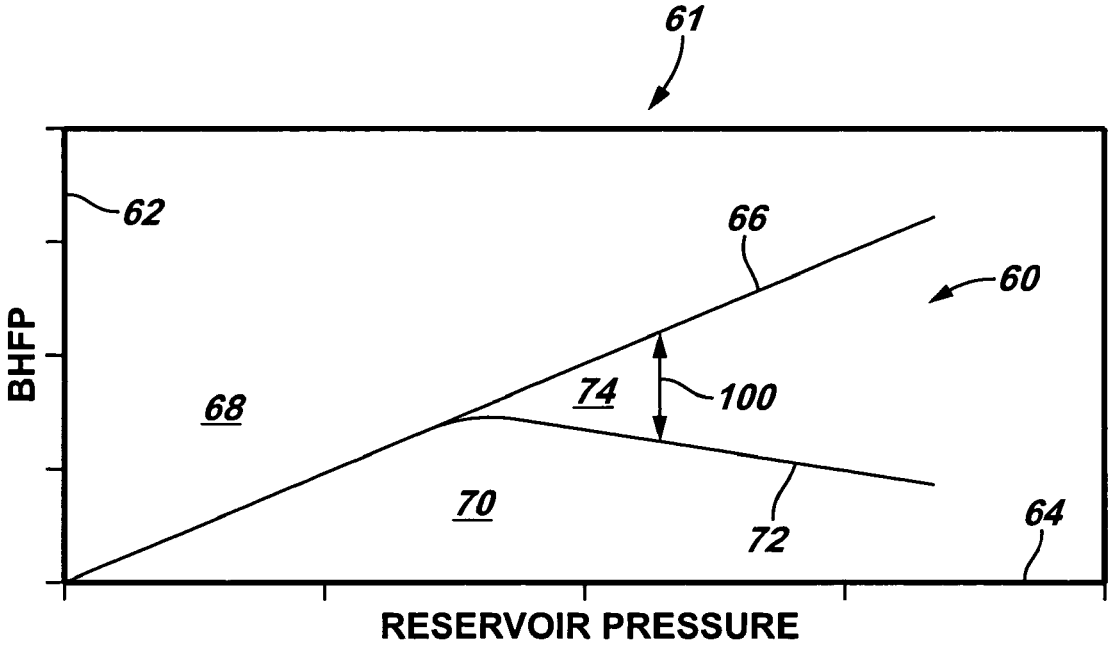
FIG. 5 is another graphical illustration of a specific stability envelope that may be used with the system illustrated in FIG. 1.

As illustrated in FIGS. 3 through 5, reservoir pressure 48 tends to decrease over time as fluid is removed from formation 22. Early in the production cycle, the reservoir pressure may be relatively high, as illustrated in FIG. 3. At this stage, the formation is able to withstand a substantial pressure underbalance as represented by arrow 96. Consequently, the wellbore fluid, e.g. oil, can be produced at a substantially higher rate.

As production continues and the reservoir is further depleted, the reservoir pressure 48 also decreases. The decreased reservoir pressure typically requires a decrease in pressure underbalance, as represented by the shorter arrow 98 in FIG. 4. This trend continues as production moves to its final stages. As illustrated by arrow 100 in FIG. 5, the useful pressure underbalance continually decreases if sanding is to be avoided. Thus, the maximum rate of fluid production continuously changes throughout the production cycle for a given formation 22. By continuously monitoring the bottom hole flowing pressure, via sensor system 50, and the reservoir pressure, via pressure sensing system 54, and comparing that data to the stability envelope 60 for a given formation 22, production can be optimized without undue risk of sanding or other formation instability. In the example discussed above with reference to FIGS. 2-5, the optimization of production involves maximizing the pressure underbalance and thus the production flow rate for formation 22.

In the systems and methodology described above, different types of control regimes may be incorporated into system 20 depending on the environmental parameters and design parameters for a given application. By way of example, controller 58 may comprise a computerized control programmed according to one or more available control algorithms. In one embodiment illustrated in FIG. 6, computerized control 58 is programmed to receive data from bottom hole flowing pressure sensor system 50 and reservoir pressure sensor system 54, as illustrated by block 102. The real-time data from sensor system 50 and sensor system 54 is compared, and the ratio of bottom hole flowing pressure to reservoir pressure is determined, as illustrated in block 104. This ratio is then compared to a stability envelope 60 stored in controller 58, as illustrated by block 106. If the ratio falls within the optimization region 80, no operational changes are made to system 20, and the status quo is maintained, as illustrated in block 108. If, however, the ratio falls outside optimization region 80, the computerized control 58 outputs appropriate control signals to automatically adjust system 20, as illustrated by block 110.

Figure 6:
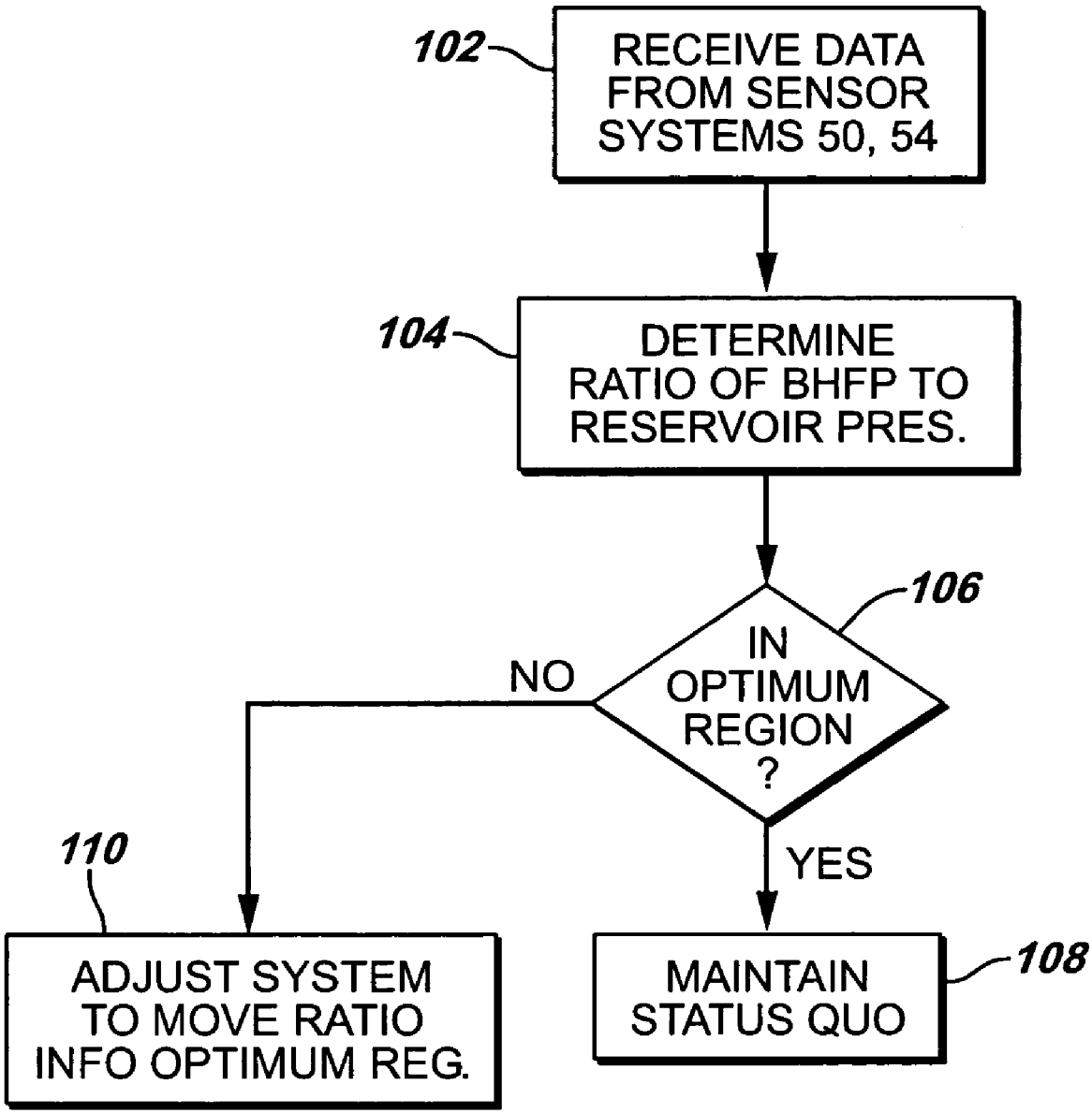
FIG. 6 is a flowchart illustrating the functionality of an automated control system, according to an embodiment of the present invention.

The specific automatic adjustment to system 20 can vary depending on the position of the ratio within the stability envelope and on system design objectives. For example, control 58 may be designed to provide signals to flow control mechanism 42 to increase the production rate if the ratio falls outside optimization region 80 but within safe drawdown region 74. When the ratio falls outside safe drawdown region 74 and in a region of stability envelope 60 representing a threat to the mechanical stability of formation 22, the production rate may be decreased. However, control system 58 may be programmed to make other system adjustments. In one embodiment, for example, control system 58 is designed to increase the sensor sampling rate when the ratio moves outside or towards the boundary of optimization region 80. It should be noted that the functionality of the control system example illustrated in FIG. 6 is representative of a variety of real-time sensing and control programs/algorithms that can be used in an automated control for controlling system 20.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of optimizing production from a formation without creating undue risk of mechanical instability of the formation, comprising:

establishing a stability envelope on a processor-based control system and programming a desired region of operation within the stability envelope;

sensing a bottom hole flowing pressure;

comparing the bottom hole flowing pressure to the stability envelope for the formation;

adjusting fluid production to maintain the bottom hole flowing pressure within the desired region of the stability envelope; and adjusting a sensor sampling rate as a function of the position of the bottom hole flowing pressure in the stability envelope.

2. The method as recited in claim 1, wherein sensing comprises sensing the bottom hole flowing pressure repeatedly and periodically.

3. The method as recited in claim 1, wherein comparing comprises utilizing the processor-based control system to automatically adjust fluid production based on the bottom hole flowing pressure.

4. The method as recited in claim 1, wherein adjusting comprises adjusting a valve to change the fluid production rate.

5. The method as recited in claim 1, wherein adjusting comprises adjusting a choke to change the fluid production rate.

6. The system as recited in claim 1, wherein adjusting comprises adjusting an artificial lift mechanism to change the fluid production rate.

7. A method of optimizing production of a fluid from a formation without incurring sanding due to mechanical instability of the formation, comprising:

monitoring in real-time a reservoir pressure of the formation and a bottom hole flowing pressure proximate a production completion;

periodically adjusting the ratio of bottom hole flowing pressure to reservoir pressure to maintain the ratio at a desired position relative to a predetermined line representative of the maximum pressure ratio underbalance for the formation;

adjusting a sensor sampling rate as a function of the ratio of bottom hole flowing pressure to reservoir pressure.

8. The method as recited in claim 7, wherein monitoring comprises utilizing a downhole pressure sensor.

9. The method as recited in claim 7, further comprising deploying a completion in a wellbore to control production of the fluid.

10. The method as recited in claim 9, wherein deploying comprises suspending the completion on a tubing through which the fluid is produced.

11. The method as recited in claim 7, wherein deploying comprises deploying a completion having a flow control mechanism adjustable to control a production rate and the bottom hole flowing pressure.

12. The method as recited in claim 7, wherein periodically adjusting comprises automatically adjusting the bottom hole flowing pressure.

* * * * *